US005176964A

United States Patent [19]

Marousek et al.

[11] Patent Number: 5,176,964

[45] Date of Patent: Jan. 5, 1993

[54] DIFFUSE BLACK PLASMA SPRAYED COATINGS

[75] Inventors: Michael E. Marousek, Baltimore; Dennis C. Nagle, Ellicott City, both of Md.; Donald F. Shepard, Evergreen, Colo.

[73] Assignee: Martin Marietta Corporation, Bethseda, Md.

[21] Appl. No.: 685,479

[22] Filed: Apr. 12, 1991

[51] Int. Cl.[5] ..... B22F 3/00; B32B 9/04

[52] U.S. Cl. ..... 428/552; 428/556; 428/565; 428/469; 428/337; 428/689; 427/162; 427/402; 427/451

[58] Field of Search ..... 428/552, 556, 565, 469, 428/337, 689; 427/34, 162, 402

[56] References Cited

U.S. PATENT DOCUMENTS

| | | | |
|---|---|---|---|
| 3,231,416 | 1/1966 | Fuller | 428/328 |
| 3,753,666 | 8/1973 | Carroll | 428/633 |
| 3,753,745 | 8/1973 | Shiroyama et al. | 106/57 |
| 3,989,872 | 10/1976 | Ball | 428/404 |
| 4,055,705 | 10/1977 | Stecura et al. | 428/633 |
| 4,269,903 | 5/1981 | Clingman et al. | 428/472 |
| 4,335,190 | 6/1982 | Bill et al. | 428/623 |
| 4,403,031 | 9/1983 | Borrelli et al. | 430/332 |
| 4,503,140 | 3/1985 | Wright | 430/289 |
| 4,562,120 | 12/1985 | Axelrod et al. | 428/469 |
| 4,645,716 | 2/1987 | Harrington et al. | 428/472 |
| 4,894,125 | 1/1990 | Fenolia et al. | 204/33 |
| 5,035,949 | 7/1991 | Shepard et al. | 428/337 |

*Primary Examiner*—Donald P. Walsh
*Assistant Examiner*—Ngoclan T. Mai
*Attorney, Agent, or Firm*—Tarolli, Sundheim & Covell

[57] ABSTRACT

The present invention resides in an optically black article comprising a substrate and an optically black coating adhered to the substrate. The coating has an absorptivity of at least about 0.92 and an emissivity of at least about 0.85, obtained by plasma spraying onto the substrate a composition comprising about 20% to about 50% by weight of a carbonyl metal and about 80% to about 50% by weight of a ceramic metal oxide. A preferred carbonyl metal is carbonyl iron. A preferred ceramic metal oxide is a yttria stabilized zirconia, having an average particle size in the range of about 10 microns to about 106 microns (140 mesh).

11 Claims, No Drawings

DIFFUSE BLACK PLASMA SPRAYED COATINGS

BACKGROUND OF THE INVENTION

1. Technical Field

The present invention relates to the preparation of diffuse, optically black, plasma sprayed coatings containing a carbonyl metal. The coatings are stable in a space environment and have a high solar absorptance and high infrared emittance.

2. Description of the Prior Art

There is a critical need, in space systems, for coating materials that are stable in the harsh environment of space; that is, that are resistant to a hard vacuum, high energy UV radiation, thermal cycling, electron bombardment, and atomic oxygen. These coatings must survive for the life of the space mission, which can be as long as fifteen years. Current coating materials are either organic based or use a ceramic glaze base. Organic materials degrade rapidly in a space environment, while ceramic glaze materials usually need a high temperature heat treatment. To save weight, the substrate in a space system is usually very thin. Such heat treatment can result in distortion of thin metal structures.

U.S. Pat. No. 3,231,416 discloses the preparation of zirconia/boron ablation coatings to provide protection to the outer surface, and especially to the thin walled nose section, of high velocity missiles or space vehicles. The coatings are obtained by plasma spraying onto the surface a powder mixture comprising 50 to 70 volume percent zirconia and 30 to 50 volume percent boron. The zirconia has a particle size of about 325 mesh and the boron has a particle size of about 100 mesh. There is no suggestion in the patent that the coatings have optically black properties.

U.S. Pat. No. 3,753,745 discloses coatings for high temperature environments, such as a furnace, prepared by flame or plasma spraying a powder mixture of zirconium oxide and 20–60 weight percent nickel and/or nickel oxide onto a substrate. The nickel or nickel oxide in the coating densifies the coating reducing porosity to less than 5%.

U.S. Pat. No. 3,753,666 discloses plasma spraying iron titanate powder ($Fe_2O_3.TiO_2$) onto a substrate of a platinum-group metal to provide a high emittance coating. The purpose is to control the surface emittance of radioisotope containment vessels for aerospace applications. The survivability of the vessel depends upon the temperature of the surface of the vessel. This temperature can be lowered to an acceptable level by the use of a high emittance coating.

U.S. Pat. No. 4,335,190 discloses applying a bond coat to a substrate by plasma spraying. The bond coat is NiCrAlY or CoCrAlY and provides a base for a ceramic top coat such as calcia stabilized zirconia or magnesia stabilized zirconia. The ceramic top coat is also plasma sprayed.

U.S. Pat. No. 3,989,872 discloses a plasma spray powder which comprises a yttria stabilized zirconia core encased in a thin calcia shell. The calcia shell promotes interparticle bonding of the zirconia.

U.S. Pat. No. 4,055,705 is similar to U.S. Pat. No. 4,335,190 and discloses a substrate, a bond coating consisting essentially of NiCrAlY covering said substrate, and a thermal barrier coating consisting essentially of zirconia stabilized with another oxide, such as calcium oxide, magnesium oxide, and yttrium oxide. Both the bond coat and the barrier coating are plasma sprayed.

U.S. Pat. No. 4,269,903 also discloses the combination of a substrate, a NiCrAlY bond coat on said substrate, and a barrier layer of yttria stabilized zirconium oxide on said bond coat. The article of this patent also contains a top abradable layer consisting essentially of porous stabilized zirconia resulting from the thermal decomposition of an organic filler material co-deposited with stabilized zirconia on the barrier layer.

U.S. Pat. No. 4,645,716 discloses applying a bond coat by flame spraying an alloy of nickel or cobalt containing chromium and/or aluminum. A ceramic composition is flame sprayed onto the bond coat, the ceramic composition comprising zirconium oxide, yttrium oxide, and titanium oxide.

SUMMARY OF THE INVENTION

The present invention resides in an optically black article comprising a substrate and an optically black coating adhered to said substrate, the coating having an absorptivity at least about 0.92 and an emissivity at least about 0.85 obtained by plasma spraying onto said substrate a powder composition comprising about 20% to about 50% by weight carbonyl metal and about 80% to about 50% by weight ceramic metal oxide. The ceramic metal oxide powder has an average particle size in the range of about 10 microns to 106 microns.

A preferred carbonyl metal is carbonyl iron. A preferred ceramic metal oxide is yttria stabilized zirconia.

DESCRIPTION OF PREFERRED EMBODIMENTS

For purposes of the present application, the term "optically black" means capable of energy absorption in both the visible (solar) region and the infrared region. In such spectral regions, the surfaces of the present invention have both a high absorptivity of solar radiation and a high emissivity in the infrared region. The surfaces of the present invention also have a high stability in a harsh space environment and are resistant to such adverse conditions as a hard vacuum, high energy UV radiation, thermal cycling, electron bombardment, and atomic oxygen. The coatings of the present invention can be applied to a substrate which is at room temperature, and thus can be applied to relatively thin substrates making the coatings of the present invention useful for space systems.

Broadly, the composition of the present invention comprises a carbonyl metal and a ceramic metal oxide powder which is inert to the carbonyl metal under plasma spray conditions. A preferred carbonyl metal is carbonyl iron. The carbonyl metal can also be other metals made by the carbonyl process. Examples of other carbonyl metals are carbonyl cobalt, carbonyl vanadium, carbonyl manganese, carbonyl nickel, and carbonyl tin.

A characteristic of carbonyl metals is that, being made by the carbonyl process, they are very small spherical powders. For instance, carbonyl iron is manufactured by the thermal decomposition of iron pentacarbonyl [$Fe(CO)_5$]. Iron pentacarbonyl is available as an intermediate, in liquid form. The liquid is vaporized resulting in controlled thermal decomposition of the iron pentacarbonyl gas. This decomposition in free space produces metallic iron as submicroscopic crystals that form, on crystallizing, microscopic spheres with a characteristic onion-skin structure. Although iron normally crystallizes in the cubic form, in the carbonyl iron process, the extremely small crystals orient at random and thus build up into spheres. The carbonyl iron powders that are produced have very small average particle sizes, in the range from two to ten microns in diameter. Actual size is controlled by regulating the operating conditions. The onion-skin structure is due to minute carbon deposits in alternating layers in the formed spheres. The carbon content is about 1%. The carbonyl iron can be reduced by exposing the powder to a hydrogen atmosphere, followed by compaction. This destroys the onion-skin structure and produces a composite of randomly arranged minute iron particles having a carbon content of about 0.075%.

Carbonyl iron powders, either reduced or unreduced, typically have an average particle size less than about 15 microns. Carbonyl iron powders are available from the Sigma Chemical Company. These powders have a particle size of about 5–15 microns. They are also available from the GAF Chemicals Corporation. The GAF carbonyl iron powders have an average particle size of about 4–6 microns. Other characteristics of the GAF powders are that they have a mass balance of about 97% to about 99.5% iron minimum. The apparent densities of the carbonyl iron powders are about 2–3 grams per cubic centimeter. On a 200 mesh screen, about 0.3% maximum powder is retained.

The amount of carbonyl iron or other carbonyl metal in the coating composition is preferably about 20% to about 50% by weight based on the weight of the coating composition. Carbonyl iron is pyrophoric and will ignite if the concentration is more than 50%. At less than 20%, the desired optical properties are not obtained.

The ceramic metal oxide of the present invention should have a high melting point and be inert or nonreactive with the carbonyl metal under the conditions of plasma spraying. A preferred ceramic metal oxide is a yttria stabilized zirconia powder marketed by Metco, Inc. under the trademark "Metco 204 NS". This composition contains, on a weight basis, about 7%–8% yttria. The powder has a melting point of about 2,480° C. and a typical size range of about 10 microns to about 106 microns (140 mesh). The zirconia may also be stabilized with calcia or magnesia. Another ceramic metal oxide that can be used is alumina.

The substrate in the practice of the present invention can be any substrate capable of withstanding exposure to plasma spraying, including many plastics. A preferred substrate is a lightweight metal alloy such as a titanium alloy, e.g., Ti-6Al-4V alloy. Other suitable substrates are aluminum, nickel, molybdenum, tantalum, niobium, tungsten, copper, and alloys thereof. The thickness of the substrate is not critical. Preferably, the substrate is as thin as possible for space systems. The substrate should have sufficient thickness to withstand the impact of the plasma spray process without distortion. However, the thickness of the substrate can be sufficiently small, e.g., as little as 0.005 inches, that if subjected to high temperatures, it could deform. Such high temperatures can be due to preheating the substrate, or subjecting the plasma-sprayed coating to heat treatment, e.g., tempering at 260°–538° C. In the practice of the present invention, the substrate typically need not be preheated prior to plasma spraying. The plasma spray procedure can be carried out with the substrate essentially at room temperature, thereby avoiding substrate distortion. Cooling of the substrate is not necessary, although preferably the substrate is maintained at relatively low temperatures by air cooling the backside of the substrate during plasma spraying, for instance to about 107°–121° C. Typically, the coatings of the present invention require no heat treatment, e.g., tempering. Generally, the thickness of the substrate will be less than one inch.

In order to achieve a good bond, the substrate is preferably coated with an intermediate bond coat alloy prior to application of the carbonyl iron/ceramic metal oxide coating. A preferred bond coat composition is a nickel or cobalt alloy containing chromium and/or aluminum. An example of one such bond coat composition is a NiCrAl alloy marketed by Metco, Inc. under the trademark "Metco 443". The composition of "Metco 443" typically is nickel-chromium alloy and about 6% aluminum. The composition has a particle size range of about 325 mesh (45 microns) to about 120 mesh, and a melting point of about 657° C. Another suitable bond coat composition is a CoNiCrAlY alloy marketed by Alloy Metals Inc. under the trade designation "995". This alloy contains on a weight basis about 38.5% cobalt, 32% nickel, 21% chromium, 8% aluminum, and less than 1% yttrium. The bond coat is applied as a thin layer, for instance about 0.002–0.008 inch, preferably about 0.002–0.005 inch. The bond coat preferably is applied using a plasma spray gun, although it can be applied by other methods, for instance by electrolytic cladding or sintering.

The plasma spray process is well known and fully described in numerous prior patents. A gas is used as a heating and carrier medium. A preferred gas is an inert gas, such as argon. A stream of the gas is heated to a high temperature by being passed through an electric arc.

The plasma expands due to its high heat and kinetic energy and produces a high velocity directional jet. The carbonyl iron/ceramic metal oxide powders injected into the rapidly flowing heated stream are heated to a sufficiently high temperature for the carbonyl iron to become softened or melted. The plasma jet is directed at a target surface, depositing the molten or softened carbonyl iron/ceramic oxide powder onto the surface. The deposit is allowed to cool by exposure to ambient conditions, aided, if desired, by the application of cooling air to the backside of the substrate. This allows the carbonyl iron/ceramic oxide particles to become bonded to the substrate and to each other in the formation of a thin layer.

For purposes of the present application, the term "plasma spray process" includes derivatives of the process which use an inert gas and are capable of heating the carbonyl iron/ceramic oxide powder to a high enough temperature to soften or melt the carbonyl iron. Included is detonation gun spraying.

Although not intending to be bound by any theory, it is believed that the surface properties achieved by the present invention are due to a thin build-up of the very fine spherical particles of the carbonyl iron on the substrate. The ceramic oxide particles function as a scavenger to collect the particles of the carbonyl iron and to convey the carbonyl iron particles to the surface of the substrate to which the carbonyl iron particles adhere. The carbonyl iron/ceramic oxide surface which is applied to the substrate by the plasma jet process has an irregular surface morphology of peaks and valleys which gives, without further treatment, good absorptivity and emissivity.

The following Examples illustrate the practice of the present invention. In these Examples, absorptivity and emissivity were measured using a Gier-Dunkle MS-251 solar reflectometer, to measure surface absorptivity, and a Gier-Dunkle DB-100 infrared reflectometer to measure surface emissivity. A Beckman DK-2A Spectrophotometer was also used to obtain absorptivity values.

EXAMPLE 1

This Example illustrates the preparation of a diffuse black coating using a plasma spray process in accordance with the present invention. The substrate in this Example was aluminum. The surface of the substrate was prepared by degreasing it with 1,1,1-trichloroethane. A bond coat was applied using a plasma spray gun manufactured by the Metco Division of Perkin-Elmer, Westbury, N.Y., Model No. 7M. The bond coat was a nickel chromium/aluminum powder marketed by Metco, Inc. under the trademark "Metco 443". The bond coat was applied following Metco recommended operating procedures. The "Metco 443" powder had a particle size of about 325 mesh (45 microns) to about 120 mesh. A thin layer of the bond coat was applied to the cleaned substrate. The bond coat had a thickness of about 0.002–0.005 inch.

A 70/30 mixture of zirconia and carbonyl iron was applied to the bond coat, using the same spray gun used to apply the bond coat. The zirconia was a yttria stabilized zirconia marketed by Metco, Inc. under the trademark "Metco 204NS". The zirconia contained about 7%–8% yttria. The stabilized zirconia had a particle size of about 10 microns to 106 microns. The carbonyl iron was marketed by Sigma Chemical Company and had a particle size of about 5–15 microns. The zirconium oxide and carbonyl iron mixture was prepared in a V-blender so that the mixture was essentially homogeneous.

The operating parameters for the plasma spray gun were as follows:

Spray Gun
- Type—7MB
- Nozzle—GH
- Uni-jet ring
- Argon insulator

Gas Pressure
- Primary (argon)—100 psi
- Secondary (hydrogen)—50 psi

Gas Flow (flowmeter reading)
- Primary (argon)—80
- Secondary (hydrogen)—15

Power
- Unit Model—7MR
- Arc Amps—500
- Arc Volts—64–70

Powder Feed
- Unit—4MP Dual
- Powder port shaft—A
- Carrier Gas Pressure—100 psi
- Flowmeter reading—37
- Feed rate indicator setting—75
- Air vibrator pressure—20–25 psi The spraying was carried out using a gun-to-work distance of about 10–15 centimeters. A thin film was desired, just covering the substrate, so that the application was by hand making four fast passes with the gun. The coated substrate was cooled to a maximum temperature of about 107°–121° C. by the application of air to the backside of the substrate. The absorptivity of the coating was about 0.93 and the emissivity was about 0.89. The coating had a dark grey appearance and was considered to be suitable, without further treatment, for use in space systems.

EXAMPLE 2

In this Example, the same procedures and gun as in Example 1 was used. The zirconia, carbonyl iron powder comprised 60 volume percent yttria stabilized zirconia ("Metco 204NS") and 40 volume percent carbonyl iron (Sigma Chemical Company). The substrate was pre-coated with a bond coat as in Example 1. The zirconia/carbonyl iron coating had an absorptivity of about 0.92 and an emissivity of about 0.85. The coating was also deemed to be suitable for use in space systems.

From the above description of preferred embodiments of the invention, those skilled in the art will perceive improvements, changes and modifications. Such improvements, changes and modifications within the skill of the art are intended to be covered by the appended claims.

Having described a specific preferred embodiment of the invention, we claim:

1. An optically black article comprising a substrate and an optically black coating adhered to said substrate, said coating having an absorptivity at least about 0.92 and an emissivity at least about 0.85 obtained by plasma spraying onto said substrate a powder composition comprising about 20% to about 50% by weight carbonyl metal and about 80% to about 50% by weight ceramic metal oxide.

2. The article of claim 1 wherein said carbonyl metal is carbonyl iron.

3. The article of claim 2 wherein said ceramic metal oxide is a yttria stabilized zirconia having an average particle size of about 10 microns to about 106 microns.

4. The article of claim 3 comprising a bond coat between said substrate and said optically black coating.

5. The article of claim 4 wherein said bond coat comprises a NiCrAl alloy plasma sprayed onto said substrate.

6. The article of claim 4 wherein said bond coat has a thickness of about 0.002–0.008 inch.

7. The article of claim 1 wherein said substrate is thin having a minimum thickness which makes said substrate subject to deformation if heated to a high temperature.

8. The article of claim 7 wherein said plasma spraying is carried out by air cooling the back side of the substrate during plasma spraying.

9. The article of claim 7 wherein said plasma spraying is carried out without preheating the substrate.

10. The article of claim 7 wherein said substrate is a material selected from the group consisting of aluminum, titanium, and alloys thereof.

11. The article of claim 10 wherein said substrate is Ti-6Al-4V.

* * * * *